US010324402B2

(12) United States Patent
Lee

(10) Patent No.: US 10,324,402 B2
(45) Date of Patent: Jun. 18, 2019

(54) BELT TYPE FIXING APPARATUS AND IMAGE FORMING APPARATUS HAVING THE SAME

(71) Applicant: HP PRINTING KOREA CO., LTD., Suwon-si, Gyeonggi-Do (KR)

(72) Inventor: Seung-jun Lee, Suwon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 169 days.

(21) Appl. No.: 15/401,513

(22) Filed: Jan. 9, 2017

(65) Prior Publication Data

US 2018/0017912 A1 Jan. 18, 2018

(30) Foreign Application Priority Data

Jul. 18, 2016 (KR) ..... 10-2016-0090896

(51) Int. Cl.
*G03G 15/20* (2006.01)

(52) U.S. Cl.
CPC ..... *G03G 15/2028* (2013.01); *G03G 15/2053* (2013.01); *G03G 2215/2035* (2013.01)

(58) Field of Classification Search
CPC ..... G03G 15/2028; G03G 15/2085; G03G 2215/2035
See application file for complete search history.

(56) References Cited

U.S. PATENT DOCUMENTS 7,130,572 B2 10/2006 Kubochi et al.
8,725,038 B2 * 5/2014 Yamaguchi ..... G03G 15/2053 399/122
8,737,896 B2 5/2014 Fujita et al.
8,798,514 B2 8/2014 Tanaka et al.
2008/0205944 A1 8/2008 Lee et al.
(Continued)

FOREIGN PATENT DOCUMENTS

JP 2007-86267 4/2007
JP 2013-186192 9/2013
(Continued)

OTHER PUBLICATIONS

International Search Report and Written Opinion dated Apr. 25, 2017 from International Application No. PCT/KR2017/001621, 11 pages.

*Primary Examiner* — Erika J Villaluna
(74) *Attorney, Agent, or Firm* — Staas & Halsey LLP

(57) ABSTRACT

A belt type fixing apparatus includes a fixing belt, a fixing roller disposed to face the fixing belt, a nip forming member that is disposed inside the fixing belt and presses the fixing belt to the fixing roller to form a fixing nip, first and second regulating surfaces that are provided at opposite ends of the nip forming member and restrict an axial movement of the fixing belt, and first and second guide surfaces that are provided inside the fixing belt and guide rotation of the fixing belt. The first regulating surface and the second regulating surface include at least one regulating step portion which is not in contact with one end of the fixing belt, respectively. The first guide surface and the second guide surface include at least one guide step portion which is not in contact with an inner surface of the fixing belt, and the at least one regulating step portion and the guide step portion are formed to be staggered from each other.

20 Claims, 23 Drawing Sheets

(56) References Cited

U.S. PATENT DOCUMENTS

| | | | | |
|---|---|---|---|---|
| 2009/0011882 | A1 | 1/2009 | Kichise et al. | |
| 2012/0243920 | A1* | 9/2012 | Fuchigama et al. | 399/329 |
| 2012/0315064 | A1 | 12/2012 | Takifuji | |
| 2013/0045032 | A1 | 2/2013 | Shimokawa et al. | |
| 2014/0301760 | A1 | 10/2014 | Nanjo et al. | |
| 2015/0104227 | A1 | 4/2015 | Shimokawa et al. | |
| 2016/0033908 | A1 | 2/2016 | Tsunashima et al. | |

FOREIGN PATENT DOCUMENTS

| | | |
|---|---|---|
| JP | 2015-75695 | 4/2015 |
| JP | 5841961 | 11/2015 |

* cited by examiner

BELT TYPE FIXING APPARATUS AND IMAGE FORMING APPARATUS HAVING THE SAME

CROSS-REFERENCE TO RELATED APPLICATIONS

This application claims the priority benefit of Korean Patent Application No. 10-2016-0090896 filed on Jul. 18, 2016, in the Korean Intellectual Property Office, the disclosure of which is incorporated herein by reference in its entirety.

BACKGROUND

1. Field

The disclosure relates to a fixing apparatus for an image forming apparatus. More particularly, the disclosure relates to a belt type fixing apparatus and an image forming apparatus having the same.

2. Description of the Related Art

Generally, an electrophotographic image forming apparatus such as a laser printer forms a developer image corresponding to print data on a printing medium, and uses a fixing apparatus to permanently fix the developer image on the printing medium by applying predetermined heat and pressure to the developer image.

The fixing apparatus may include a pair of rollers, that is, a heating roller that generates a predetermined heat to be applied to the printing medium and a fixing roller that applies a predetermined pressure to the printing medium.

In recent years, in image forming apparatuses capable of high-speed printing, a belt type fixing apparatus using a fixing belt, which is an endless belt, is widely used instead of the heating roller.

As illustrated in FIG. 1, a conventional belt type fixing apparatus guides the rotation of a fixing belt 210 by using guide bushes 200 provided at the opposite ends of the fixing belt 210. A first surface 201 of the guide bush 200 restricts an axial movement of the fixing belt 210, and a second surface 203 of the guide bush 200 supports the rotation of the fixing belt 210 inside the fixing belt 210. The first surface 201 and the second surface 203 of the guide bush 200 are formed to be perpendicular to each other.

At this time, at a connecting portion 205 between the first surface 201 and the second surface 203 of the guide bush 200 forming the right angle, there exists a tool shape (or tool trace) which is generated when the guide bush 200 is machined. For example, as illustrated in FIG. 2, a round having a predetermined curvature is formed at the connecting portion 205 between the first surface 201 and the second surface 203 of the guide bush 200.

While the fixing belt 210 rotates, the fixing belt 210 receives an axial force B. Then, as illustrated in FIG. 3, the fixing belt 210 is moved in the axial direction along the second surface 203 by the axial force B, so that one end 210*a* of the fixing belt 210 climbs up along the round shape 205 formed between the first surface 201 and the second surface 203. Then, the one end 210*a* of the fixing belt 210 receives a force that acts from the inside of the fixing belt 210 to the outside to cause the one end 210*a* of the fixing belt 210 to be spread out. Accordingly, when the fixing belt 210 repeatedly rotates along the guide bush 200, the one end 210*a* of the fixing belt 210 is cracked and broken.

Accordingly, the development of a belt type fixing apparatus capable of suppressing fatigue cracks at opposite ends of the fixing belt 210 has been demanded.

SUMMARY

Additional aspects and/or advantages will be set forth in part in the description which follows and, in part, will be apparent from the description, or may be learned by practice of the disclosure.

The disclosure has been developed in order to overcome the above drawbacks and other problems associated with the conventional arrangement. An aspect of the disclosure relates to a belt type fixing apparatus that can minimize occurrence of cracks at opposite ends of a fixing belt and an image forming apparatus having the same.

According to an aspect of the disclosure, a belt type fixing apparatus may include a fixing belt, a fixing roller disposed to face the fixing belt, a nip forming member that is disposed inside the fixing belt and presses the fixing belt to the fixing roller to form a fixing nip, first and second regulating surfaces that are provided at opposite ends of the nip forming member and restrict an axial movement of the fixing belt, and first and second guide surfaces that are provided inside the fixing belt and guide rotation of the fixing belt. The first regulating surface and the second regulating surface may include at least one regulating step portion which is not in contact with one end of the fixing belt, respectively. The first guide surface and the second guide surface may include at least one guide step portion which is not in contact with an inner surface of the fixing belt. The at least one regulating step portion and the guide step portion may be formed to be staggered from each other.

The first regulating surface and the first guide surface may be formed integrally with a first guide bush which is provided at the one end of the fixing belt, and the second regulating surface and the second guide surface may be formed integrally with a second guide bush which is provided at another end of the fixing belt.

An entire portion of each of the first and second guide surfaces may be substantially perpendicular to each of the first and second regulating surfaces in an axial direction of the fixing belt, and at least portion of each of opposite ends of a bottom surface of the fixing belt that is in contact with the opposite ends of the fixing belt contacting the first and second regulating surfaces may be in contact with each of the first and second guide surfaces.

The first regulating surface and the second regulating surface may include at least one sub-regulating surface that is in contact with the one end of the fixing belt, respectively, the first guide surface and the second guide surface may include at least one sub-guide surface that is in contact with the inner surface of the fixing belt, and the at least one sub-regulating surface and the at least one sub-guide surface may be staggered so as not to intersect each other.

The first regulating surface and the second regulating surface may include an entrance end where the fixing belt enters, respectively, and an angle between the entrance end and a tangent line of the fixing belt at a point where the fixing belt enters the entrance end may be in a range of about 85 degrees to about 95 degrees.

According to another aspect of the disclosure, a belt type fixing apparatus may include a fixing belt, a fixing roller provided to face the fixing belt, a nip forming member that is provided inside the fixing belt and presses the fixing belt to the fixing roller to form a fixing nip, first and second regulating surfaces that are provided at opposite ends of the nip forming member and restrict an axial movement of the fixing belt, and first and second guide surfaces that are provided inside the fixing belt and guide rotation of the fixing belt. The first regulating surface may be provided on a first guide bush disposed at one end of the fixing belt and the second regulating surface may be provided on a second guide bush disposed at another end of the fixing belt. The first guide surface and the second guide surface may be formed adjacent to the first guide bush and the second guide bush on opposite sides of the nip forming member.

The nip forming member may include a plurality of guide ribs formed in a longitudinal direction, and the first guide surface and the second guide surface may be formed by two guide ribs provided at the opposite ends of the plurality of guide ribs.

Other objects, advantages and salient features of the disclosure will become apparent from the following detailed description, which, taken in conjunction with the annexed drawings, discloses preferred embodiments.

BRIEF DESCRIPTION OF THE DRAWINGS

These and/or other aspects and advantages of the disclosure will become apparent and more readily appreciated from the following description of the embodiments, taken in conjunction with the accompanying drawings of which.

DETAILED DESCRIPTION

Figure 1:
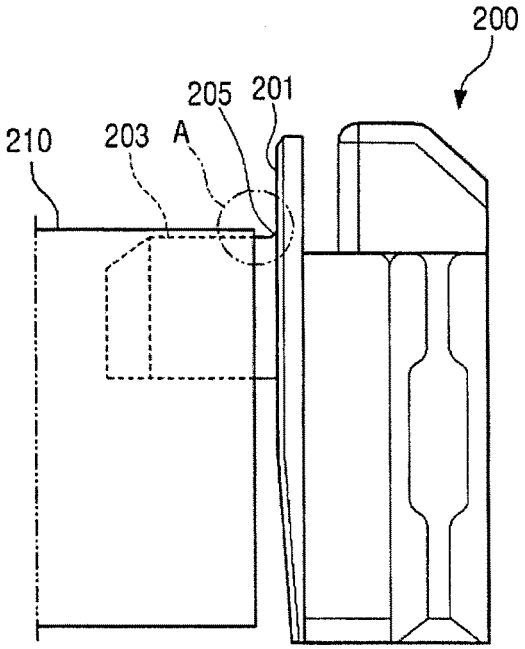
PRIOR ART FIG. 1
FIG. 1 is a partial view illustrating a state in which a guide bush used in a conventional belt type fixing apparatus guides a fixing belt.
Figure 2:
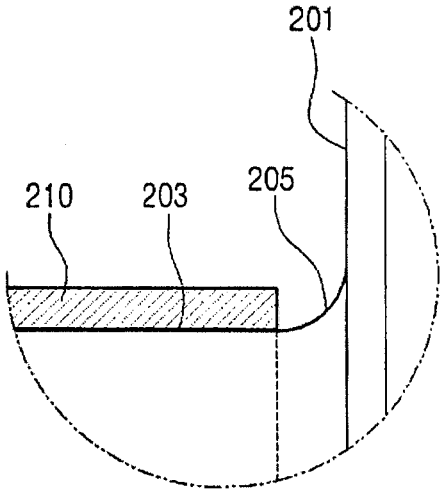
PRIOR ART FIG. 2
FIG. 2 is an enlarged partial view illustrating an A portion of FIG. 1.
Figure 3:
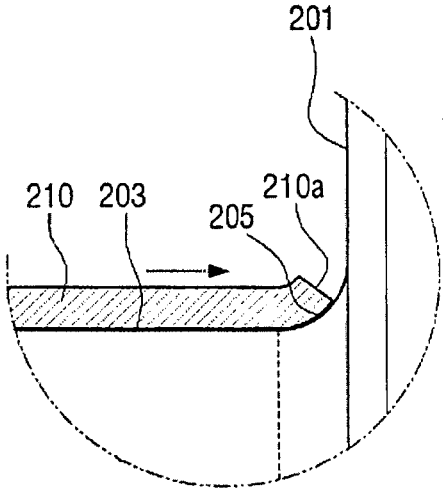
PRIOR ART FIG. 3
FIG. 3 is a view illustrating a state in which the fixing belt is moved along a second surface of the guide bush in the A portion of FIG. 1.

Reference will now be made in detail to example embodiments which are illustrated in the accompanying drawings, wherein like reference numerals refer to like elements throughout. The embodiments are described below to explain the disclosure by referring to the figures. Throughout the drawings, like reference numerals will be understood to refer to like parts, components and structures.

Hereinafter, certain exemplary embodiments of the disclosure will be described in detail with reference to the accompanying drawings.

The matters defined herein, such as a detailed construction and elements thereof, are provided to assist in a comprehensive understanding of this description. Thus, it is apparent that exemplary embodiments may be carried out without those defined matters. Also, well-known functions or constructions are omitted to provide a clear and concise description of exemplary embodiments. Further, dimensions of various elements in the accompanying drawings may be arbitrarily increased or decreased for assisting in a comprehensive understanding.

Figure 4:
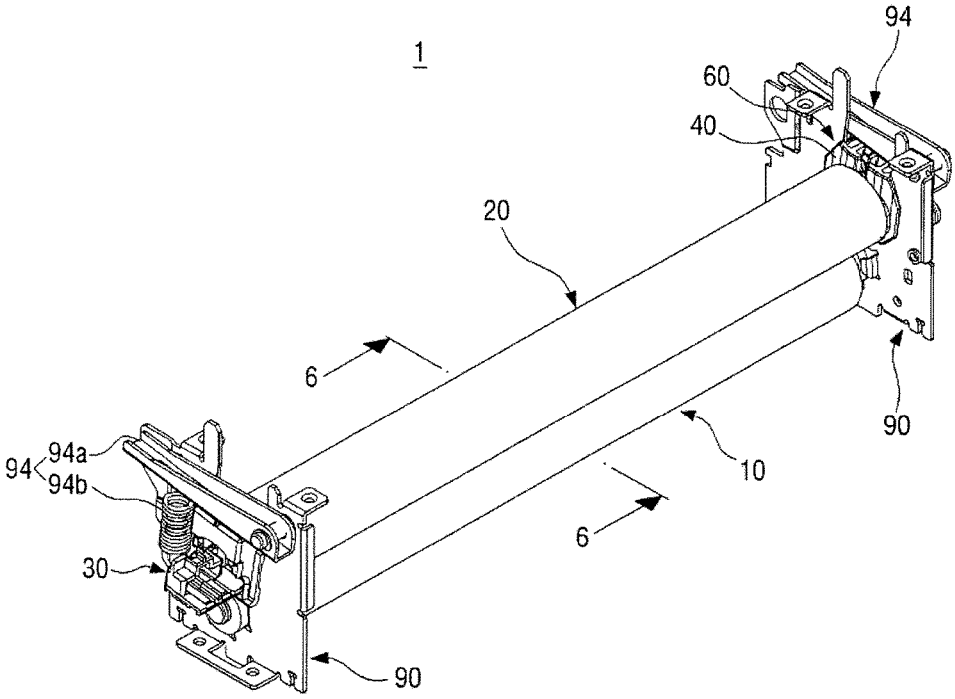
FIG. 4 is a perspective view illustrating a belt type fixing apparatus according to an embodiment of the disclosure.
Figure 5:
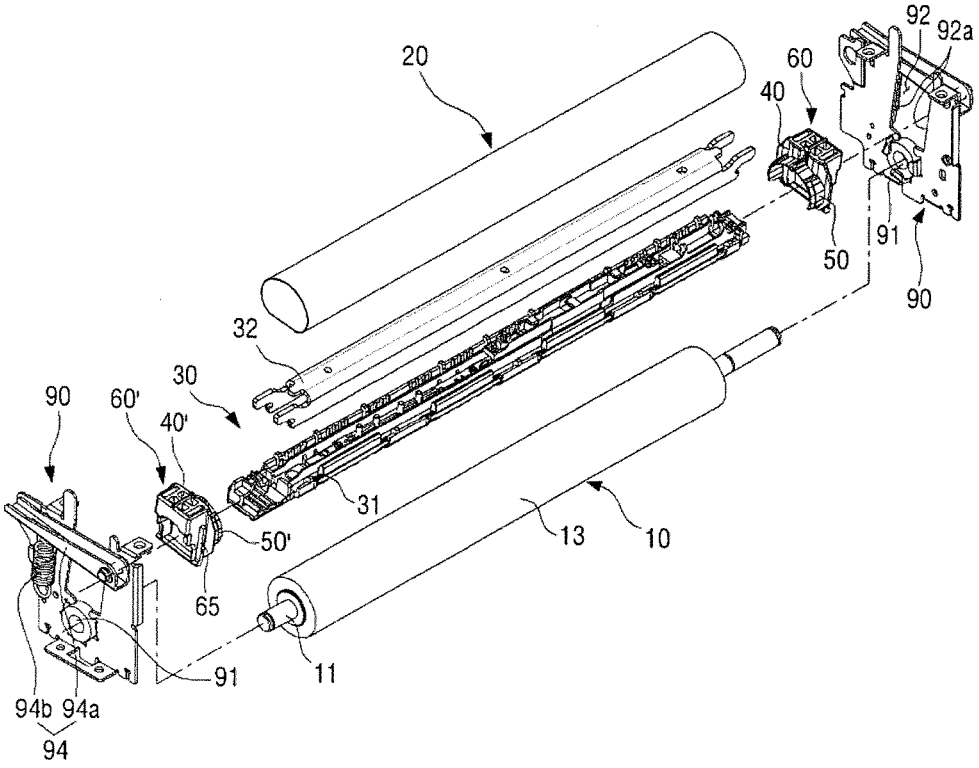
FIG. 5 is an exploded perspective view illustrating the belt type fixing apparatus of FIG. 4.

FIG. 4 is a perspective view illustrating a belt type fixing apparatus according to an embodiment of the disclosure. FIG. 5 is an exploded perspective view illustrating the belt type fixing apparatus of FIG. 4, and FIG. 6 is a cross-sectional view illustrating the belt type fixing apparatus of FIG. 4 taken along a line 6-6.

Figure 6:
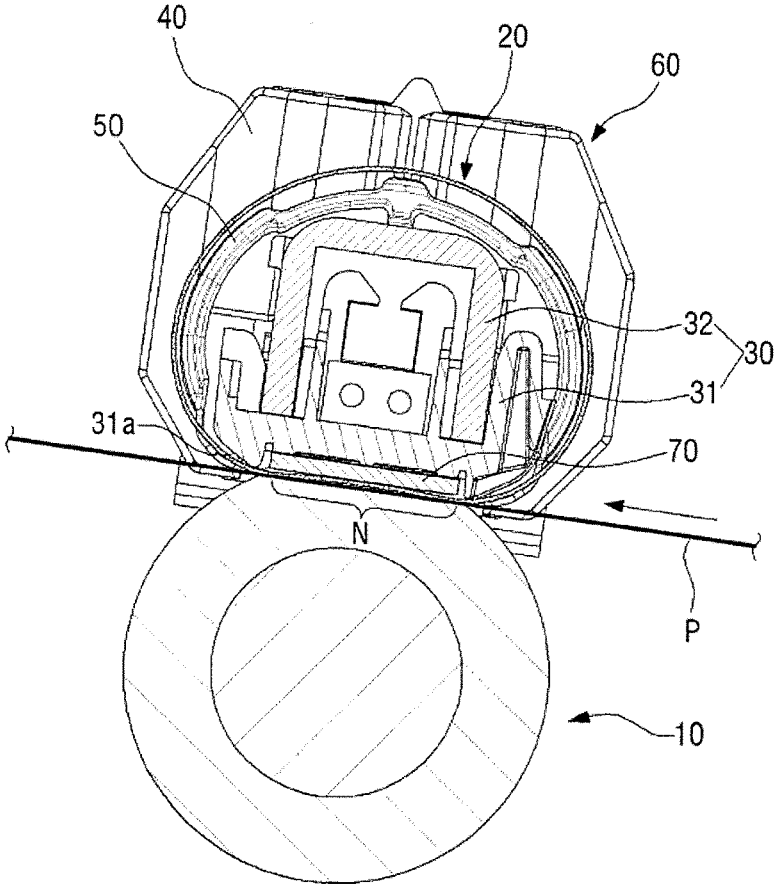
FIG. 6 is a cross-sectional view illustrating the belt type fixing apparatus of FIG. 4 taken along a line 6-6.

Referring to FIGS. 4, 5, and 6, a belt type fixing apparatus 1 according to an embodiment of the disclosure may include a fixing roller 10, a fixing belt 20, a nip forming member 30, a pair of regulating surfaces 40, and a pair of guide surfaces 50.

The fixing roller 10 is to apply a predetermined pressure to a printing medium P, and is formed in a roller shape. The fixing roller 10 may include a shaft 11 formed of a metallic material such as aluminum or steel and an elastic layer 13 elastically deformed to form a fixing nip N with the fixing belt 20. The elastic layer 13 is generally formed of silicon rubber. The fixing roller 10 is rotatably supported by a pair of supporting brackets 90. The pair of supporting brackets 90 are provided with bearings 91 capable of supporting the shaft 11.

Although not illustrated in FIGS. 4 to 6, the fixing roller 10 is configured to rotate by receiving power from a driving source such as a motor. The structure in which the fixing roller 10 is rotated by the driving source is the same as or similar to the driving structure of the conventional fixing roller; therefore, a detailed description thereof is omitted.

The fixing belt 20 is to apply predetermined heat to the printing medium P, and is formed of a substantially cylindrical endless belt. The fixing belt 20 is heated by a heat source in the same manner as a heating roller according to the prior art, thereby transferring heat to the printing medium P passing through the fixing nip N. Accordingly, the fixing belt 20 is disposed to face the fixing roller 10, and forms the fixing nip N through which the printing medium P passes with the fixing roller 10. When the fixing roller 10 rotates, the fixing belt 20 is rotated by a friction force between the fixing belt 20 and the fixing roller 10. The axial length of the fixing belt 20 may be longer than the axial length of the fixing roller 10.

The fixing belt 20 may be formed in a variety of structures. For example, the fixing belt 20 may be composed of a single layer formed of a metal sleeve, a heat-resistant resin film or the like. Alternatively, the fixing belt 20 may be composed of a base layer formed of a metal sleeve, a heat-resistant resin film or the like, and release layers formed on opposite side surfaces of the base layer. At this time, the release layer may be formed only on one surface facing the fixing roller 10. Alternatively, the fixing belt 20 may include an elastic layer provided between the base layer and the release layer. The fixing belt 20 may be the same as or similar to the fixing belt used in the conventional belt type fixing apparatus; therefore, a detailed description of the structure of the fixing belt 20 is omitted.

The nip forming member 30 is provided inside the fixing belt 20, and supports an inner surface of the fixing belt 20 so that the fixing belt 20 is in contact with the fixing roller 10 to form the fixing nip N. The nip forming member 30 has a length longer than the length of the fixing roller 10. In detail, the nip forming member 30 may include a guiding member 31 that is in contact with the inner surface of the fixing belt 20 to guide and press the fixing belt 20, and a supporting member 32 that is disposed on an upper side of the guiding member 31 and supports the guiding member 31.

The guiding member 31 is in contact with the inner surface of the fixing belt 20 to form the fixing nip N, and guides the fixing belt 20 so that the fixing belt 20 can move smoothly in the vicinity of the fixing nip N. The guiding member 31 may be formed in a channel shape whose cross-section has a substantially U shape with a flat bottom, and the supporting member 32 is provided inside the guiding member 31. A plurality of guide ribs may be provided in the longitudinal direction on both side surfaces of the guiding member 31.

The supporting member 32 reinforces the guiding member 31 so as to minimize the bending deformation of the guiding member 31. The supporting member 32 may be formed in a channel shape whose cross-section has a substantially U shape with a flat bottom, and is disposed inside the guiding member 31. The supporting member 32 may be formed in a structure having a large cross-sectional moment of inertial such as an I-beam, an H-beam, etc., in addition to the U shape having a flat bottom.

As illustrated in FIG. 6, the bottom surface of the nip forming member 30, that is, the bottom surface 31a of the guiding member 31 is in contact with the inner surface of the fixing belt 20, and an upper portion of the fixing roller 10 that is in contact with a portion of the fixing belt 20 supported by the bottom surface 31a of the guiding member 31 forms the fixing nip N. Accordingly, when the fixing roller 10 rotates, the fixing belt 20 is rotated by friction with the fixing roller 10.

Opposite ends of the guiding member 31 are supported by the pair of supporting brackets 90. The pair of supporting brackets 90 are fixed to a frame of an image forming apparatus that is not illustrated. The pair of supporting brackets 90 are provided with a pair of guide bushes 60 and 60'. The pair of guide bushes 60 and 60' are inserted into guide grooves 92 provided in the pair of supporting brackets 90, and can slide up and down along the side walls 92*a* of the guide groove 92. Accordingly, opposite side surfaces of each of the guide bushes 60 and 60' are provided with insertion slots 65 in the longitudinal direction. When the side walls 92*a* of the guide groove 92 of each of the supporting brackets 90 are inserted into the insertion slots 65 provided in the opposite side walls 92*a* of each of the guide bushes 60 and 60', the guide bushes 60 and 60' may slide up and down with respect to the supporting brackets 90. In other words, the side walls 92*a* of the guide groove 92 of the supporting bracket 90 may function as a guide rail for guiding the movement of the guide bushes 60 and 60'.

A pressing member 94 for pressing the guide bush 60 and 60' is provided on one surface of the supporting bracket 90. The pressing member 94 may include a pressing link 94*a* rotatably disposed in the supporting bracket 90 and a coil spring 94*b* connected to the pressing link 94*a*. The pressing link 94*a* is provided to be in contact with the top of each of the guide bushes 60 and 60'. One end of the coil spring 94*b* is fixed to the pressing link 94*a*, and the other end of the coil spring 94*b* is fixed to the frame (not illustrated) of the image forming apparatus, thereby applying a force pulling the pressing link 94*a* downward. Accordingly, when the coil spring 94*b* applies the force pulling the pressing link 94*a* downward, the guide bushes 60 and 60' are urged in a downward direction. When the guide bushes 60 and 60' are urged downward, the guiding member 31 is also urged in the downward direction so that the fixing nip N is formed between the fixing belt 20 and the fixing roller 10.

The pair of regulating surfaces 40 and 40', that is, a first regulating surface 40 and a second regulating surface 40' are provided at the opposite ends of the fixing belt 20, and restrict axial movement of the fixing belt 20. A pair of guide surfaces 50 and 50', that is, a first guide surface 50 and a second guide surface 50' are provided to abut or contact with the pair of regulating surfaces 40 and 40', and support inner surfaces of the opposite end portions of the fixing belt 20 so that the fixing belt 20 can rotate. In other words, the first and second guide surfaces 50 and 50' are provided inside the fixing belt 20 and are formed to guide the rotation of the fixing belt 20.

The pair of regulating surfaces 40 and 40' and the pair of guide surfaces 50 and 50' are provided to be perpendicular to each other. In detail, the first regulating surface 40 is provided at one end of the fixing belt 20 to be perpendicular to the first guide surface 50, and the second regulating surface 40' is provided at the other end of the fixing belt 20 to be perpendicular to the second guide surface 50'.

The first guide surface 50 is provided in the axial direction of the fixing belt 20 such that the entire surface of the first guide surface 50 is perpendicular to the first regulating surface 40. In other words, the entire width of the first guide surface 50 is formed to be perpendicular to the first regulating surface 40. Accordingly, unlike the guide bush 200 (see FIG. 1) according to the prior art, there is no round shape 205 at a portion where the first regulating surface 40 and the first guide surface 50 are connected or contacted with each other. Accordingly, in the belt type fixing apparatus 1 according to an embodiment of the disclosure, even when the fixing belt 20 moves in the axial direction to be close to the first regulating surface 40, the force that causes the end portion of the fixing belt 20 to be spread like a morning glory is not applied to the fixing belt 20.

Further, the first guide surface 50 is provided to be able to contact and support at least a portion of the edge of the bottom surface of the fixing belt 20 connected to one end of the fixing belt 20 which is in contact with or adjacent to the first regulating surface 40.

The second regulating surface 40' and the second guide surface 50' may be formed in the same manner as the first regulating surface 40 and the first guide surface 50 as described above; therefore, detailed descriptions thereof are omitted.

The first and second regulating surfaces 40 and 40' and the first and second guide surfaces 50 and 50' as described above may be formed in a variety of manners.

For example, the regulating surfaces 40 and 40' and the guide surfaces 50 and 50' may be provided in a single guide bush 60 and 60'. In detail, the first regulating surface 40 and the first guide surface 50 may be provided integrally with a first guide bush 60 disposed at one end of the fixing belt 20, and the second regulating surface 40' and the second guide surface 50' may be provided integrally with a second guide bush 60' disposed at the other end of the fixing belt 20.

In the following description, the first and second regulating surfaces 40 and 40' are collectively referred to as a regulating surface 40, and the first and second guide surfaces 50 and 50' are collectively referred to as a guide surface 50. Also, the first and second guide bushes 60 and 60' are collectively referred to as a guide bush 60. However, if necessary, the first and second regulating surfaces 40 and 40', the first and second guide surfaces 50 and 50', and the first and second guide bushes 60 and 60' may be used separately.

Hereinafter, a guide bush provided with a regulating surface and a guide surface usable in a belt type fixing apparatus according to an embodiment of the disclosure will be described in detail with reference to FIG. 7.

Figure 7:
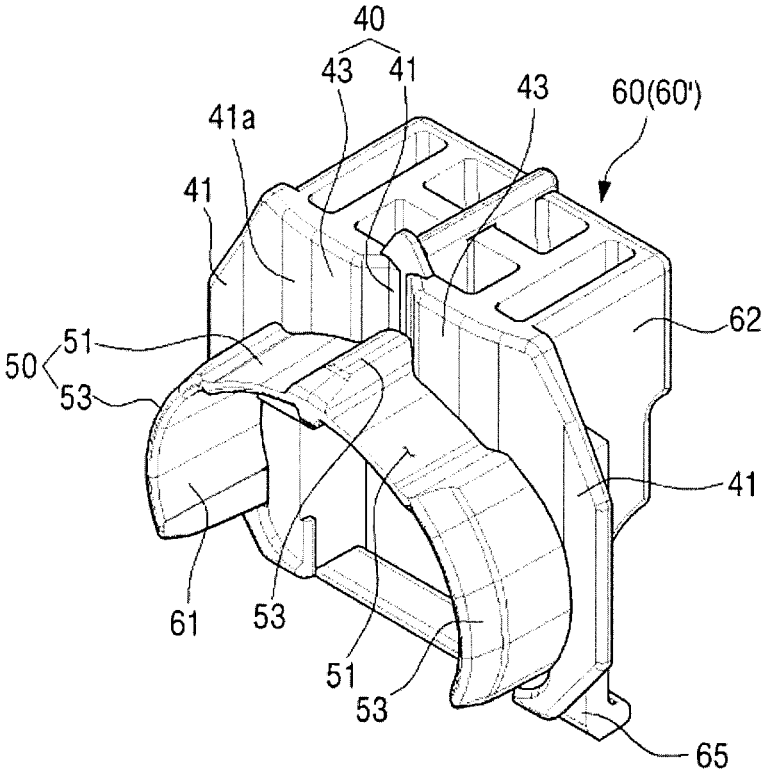
FIG. 7 is a perspective view illustrating an example of a guide bush used in a belt type fixing apparatus according to an embodiment of the disclosure.

FIG. 7 is a perspective view illustrating an example of a guide bush used in a belt type fixing apparatus according to an embodiment of the disclosure.

Referring to FIG. 7, a guide bush 60 may include a fixed body 62 and a rotary support part 61. The fixed body 62 is formed to be slidable up and down with respect to the supporting bracket 90 of the fixing apparatus. The fixed body 62 is formed in a substantially octagonal shape, the rotary support part 61 is provided on the front surface of the fixed body 62, and the insertion slots 65 into which the opposite side walls 92*a* of the supporting bracket 90 are inserted are formed on opposite side surfaces of the fixed body 62.

The front surface of the fixed body 62 is provided with the regulating surface 40 for restricting the axial movement of the fixing belt 20. The regulating surface 40 may include at least one regulating step portion 41 with which one end of the fixing belt 20 is not in contact. Since the regulating step portion 41 is formed to be lower in height than the regulating surface 40, when one end of the fixing belt 20 is in contact with the regulating surface 40, the regulating step portion 41 is not in contact with the one end of the fixing belt 20. In other words, the fixed body 62 is formed so that the entire front surface 40 does not restrict the one end of the fixing belt 20 but only a portion of the front surface 40 restricts the one end of the fixing belt 20.

Also, the regulating surface 40 may include at least one sub-regulating surface 43 in contact with the one end of the fixing belt 20. Accordingly, the regulating surface 40 may include at least one sub-regulating surface 43 and at least one regulating step portion 41 that are formed alternately. When the one end of the fixing belt 20 is in contact with the regulating surface 40, the sub-regulating surface 43 is in contact with the one end of the fixing belt 20, and the regulating step portion 41 is not in contact with the one end of the fixing belt 20.

A portion 41a of the regulating step portion 41 connected to the sub-regulating surface 43 is formed to be inclined upward in the rotational direction of the fixing belt 20. Accordingly, when the fixing belt 20 rotates, the one end of the fixing belt 20 may easily enter the sub-regulating surface 43 of the guide bush 60.

The rotary support part 61 extends perpendicularly from the front surface of the fixed body 62, and supports the fixing belt 20 to rotate. The rotary support part 61 may be formed in a variety of shapes as long as it can support the rotation of the fixing belt 20. In FIG. 7, the rotary support part 61 formed in an arc shape or an arch shape for providing a space below the rotary support part 61 is illustrated. Accordingly, a predetermined space is provided below the rotary support part 61. Further, the rotary support part 61 may be formed in an arc shape that is larger or smaller than a semi-circle. In the embodiment, the rotary support part 61 is formed in an arc shape substantially larger than the semi-circle. The guide surface 50 is formed on the top surface of the rotary support part 61.

The guide surface 50 may include at least one guide step portion 51 that is not in contact with the inner surface of the fixing belt 20. The guide step portion 51 is formed to be lower in height than the guide surface 50, and when the inner surface of the fixing belt 20 is in contact with the guide surface 50, the guide step portion 51 is not in contact with the inner surface of the fixing belt 20. In other words, the guide surface 50 is formed so that the entire portion of the guide surface 50 does not support the inner surface of the fixing belt 20 but only a portion of the guide surface 50 supports the inner surface of the fixing belt 20. Since a point where the portion of the guide surface 50 that supports the inner surface of the fixing belt 20 meets the front surface of the fixed body 62 is positioned at the inner side than the point where the regulating surface 40 meets the guide surface 50, the one end of the fixing belt 20 is not in contact with the point where the portion of the guide surface 50 supporting the inner surface of the fixing belt 20 meets the front surface of the fixed body 62.

Further, the guide surface 50 may include at least one sub-guide surface 53 in contact with the inner surface of the fixing belt 20. Accordingly, the guide surface 50 may include at least one sub-guide surface 53 and at least one guide step portion 51 that are formed alternately. When the inner surface of the fixing belt 20 is in contact with the guide surface 50, the sub-guide surface 53 is in contact with the inner surface of the fixing belt 20, and the guide step portion 51 is not in contact with the inner surface of the fixing belt 20.

Further, the at least one guide step portion 51 and the at least one regulating step portion 41 are formed to be staggered from each other. In other words, the at least one sub-guide surface 53 and the at least one sub-regulating surface 43 are provided to be staggered from each other. Accordingly, the at least one sub-regulating surface 43 and the at least one sub-guide surface 53 do not intersect each other, the at least one sub-regulating surface 43 intersects with the at least one guide step portion 51, and the at least one sub-guide surface 53 intersects with the at least one regulating step portion 41.

For example, referring to FIG. 7, the guide surface 50 may include three sub-guide surfaces 53 and two guide step portions 51 provided therebetween. Also, the regulating surface 40 may include two sub-regulating surfaces 43 and three regulating step portions 41. One regulating step portion 41 is provided between the two sub-regulating surface 43, and two regulating step portions 41 are provided outside the two sub-regulating surfaces 43. Accordingly, the three sub-guide surfaces 53 are formed to intersect at right angles with the three regulating step portions 41, respectively. Accordingly, a rounded tool shape is formed at each portion where the three sub-guide surfaces 53 and the three regulating step portions 41 are connected. However, since the height of the regulating step portion 41 is lower than that of the sub-regulating surface 43, the connecting portion between the sub-guide surface 53 and the regulating step portion 41 is located inside than the sub-regulating surface 43. Accordingly, when the fixing belt 20 guided by the three sub-guide surface 53 moves in the axial direction, the one end of the fixing belt 20 is in contact with only the sub-regulating surface 43 and is not in contact with the round shape of the connecting portion of the sub-guide surface 53.

At this time, the number of the at least one regulating step portion 41 may be formed to be larger than that of the at least one guide step portion 51. In other words, the number of the at least one sub-guide surface 53 may be formed to be larger than the number of the at least one sub-regulating surface 43. Since the guide bush 60 as illustrated in FIG. 7 is provided with two sub-regulating surfaces 43 and three sub-guide surfaces 53, the number of the sub-guide surfaces 53 is one more than the number of the sub-regulating surfaces 43.

Figure 8:
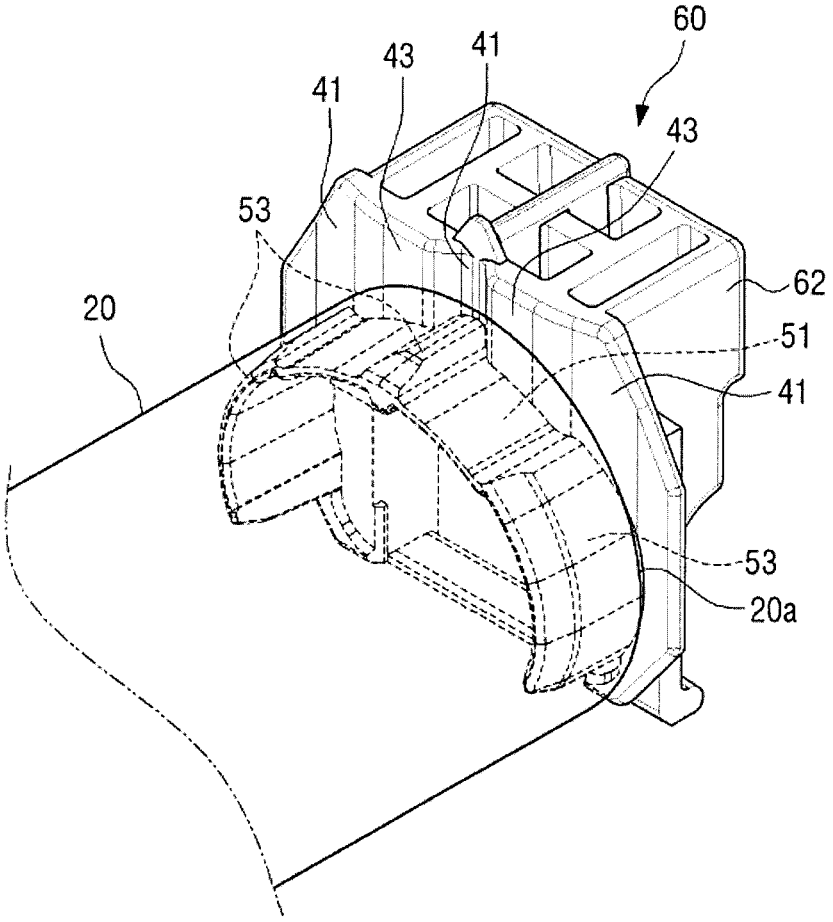
FIG. 8 is a partial perspective view illustrating a state in which the guide bush of FIG. 7 guides the fixing belt.
Figure 9:
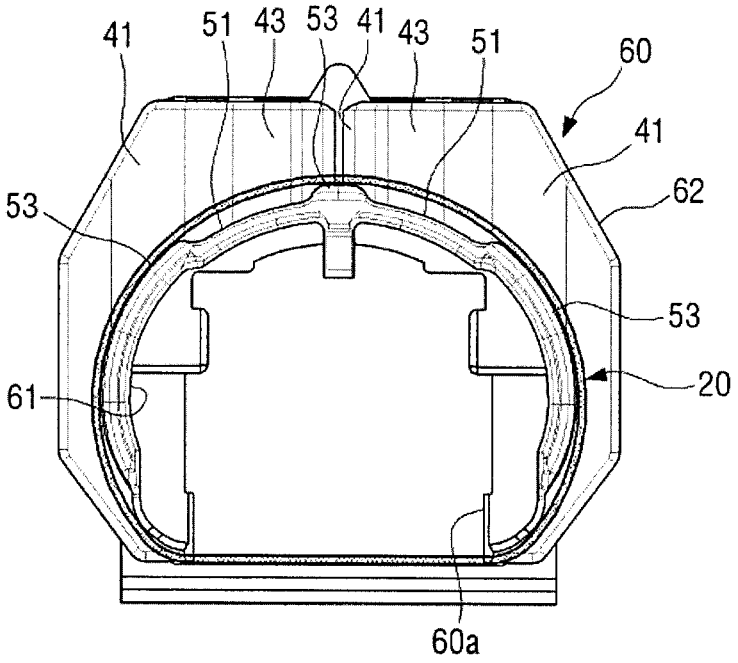
FIG. 9 is a view illustrating a state in which the guide bush of FIG. 7 guides the fixing belt.

FIG. 8 is a partial perspective view illustrating a state in which the guide bush of FIG. 7 guides the fixing belt, and FIG. 9 is a view illustrating a state in which the guide bush of FIG. 7 guides the fixing belt.

As illustrated in FIGS. 8 and 9, when the fixing belt 20 rotates, the inner surface adjacent to one end 20*a* of the fixing belt 20 is supported by the three sub-guide surfaces 53, and the one end 20*a* of the fixing belt 20 is restricted by the two sub-regulating surfaces 43. At this time, since the sub-regulating surface 43 protrudes toward the guide surface 50 more than the connecting portion between the sub-guide surface 53 and the regulating step portion 41, the one end 20*a* of the fixing belt 20 is not in contact with the connecting portion between the guide surface 50 and the regulating surface 40. Also, when the one end 20*a* of the fixing belt 20 is in contact with the sub-regulating surface 43, the one end 20*a* of the fixing belt 20 is not in contact with the regulating step portion 41. Accordingly, the one end 20*a* of the fixing belt 20 does not receive the force acting from the inside to the outside by the round shape of the connecting portion.

In the above description, the guide surface 50 includes three sub-guide surfaces 53, and the regulating surface 40 includes two sub-regulating surfaces 43. However, the number of the sub-guide surfaces 53 constituting the guide surface 50 and the number of the sub-regulating surfaces 43 constituting the regulating surface 40 are not limited thereto. For example, the regulating surface 40 may include one sub-regulating surface 43 or three or more sub-regulating surfaces 43, and the guide surface 50 may include one sub-guide surface 53 or four or more sub-guide surfaces 53.

Hereinafter, as another example of the guide bush, with reference to FIGS. 10 to 12, a guide bush 60*a* will be described in which the guide surface 50 includes two sub-guide surfaces 53, and the regulating surface 40 includes one sub-regulating surface 43.

Figure 10:
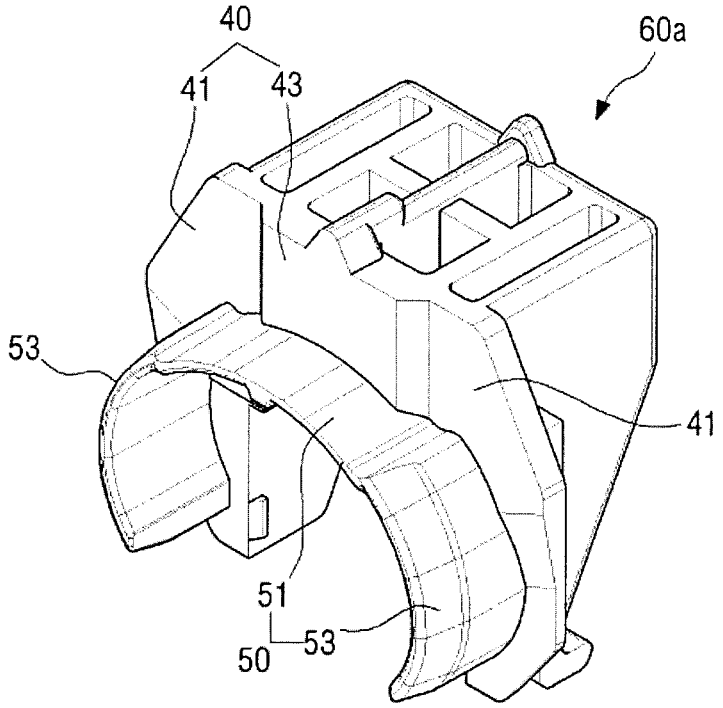
FIG. 10 is a perspective view illustrating another example of a guide bush used in a belt type fixing apparatus according to an embodiment of the disclosure.

FIG. 10 is a perspective view illustrating another example of a guide bush used in a belt type fixing apparatus according to an embodiment of the disclosure. FIG. 11 is a partial perspective view illustrating a state in which the guide bush of FIG. 10 guides the fixing belt, and FIG. 12 is a view illustrating a state in which the guide bush of FIG. 10 guides the fixing belt.

Referring to FIG. 10, the guide surface 50 may include two sub-guide surfaces 53 and one guide step portion 51 provided between the two sub-guide surfaces 53. Also, the regulating surface 40 may include one sub-regulating surface 43 and two regulating step portions 41. The two regulating step portions 41 are provided on opposite sides of the one sub-regulating surface 43. Accordingly, the two sub-guide surfaces 53 are formed to intersect at right angles with the two regulating step portions 41, respectively. Accordingly, a rounded tool shape is formed at each connecting portion where the two sub-guide surfaces 53 and the two regulating step portions 41 are connected. At this time, since the regulating step portion 41 is lower than the sub-regulating surface 43, the connecting portion between the sub-guide surface 53 and the regulating step portion 41 is located inside than the sub-regulating surface 43. Accordingly, when the fixing belt 20 guided by the two sub-guide surfaces 53 moves in the axial direction, the one end of the fixing belt 20 is only in contact with the sub-regulating surface 43, and does not move along the round shape of the connecting portion between the sub-guide surface 53 and the regulating step portion 41.

Figure 11:
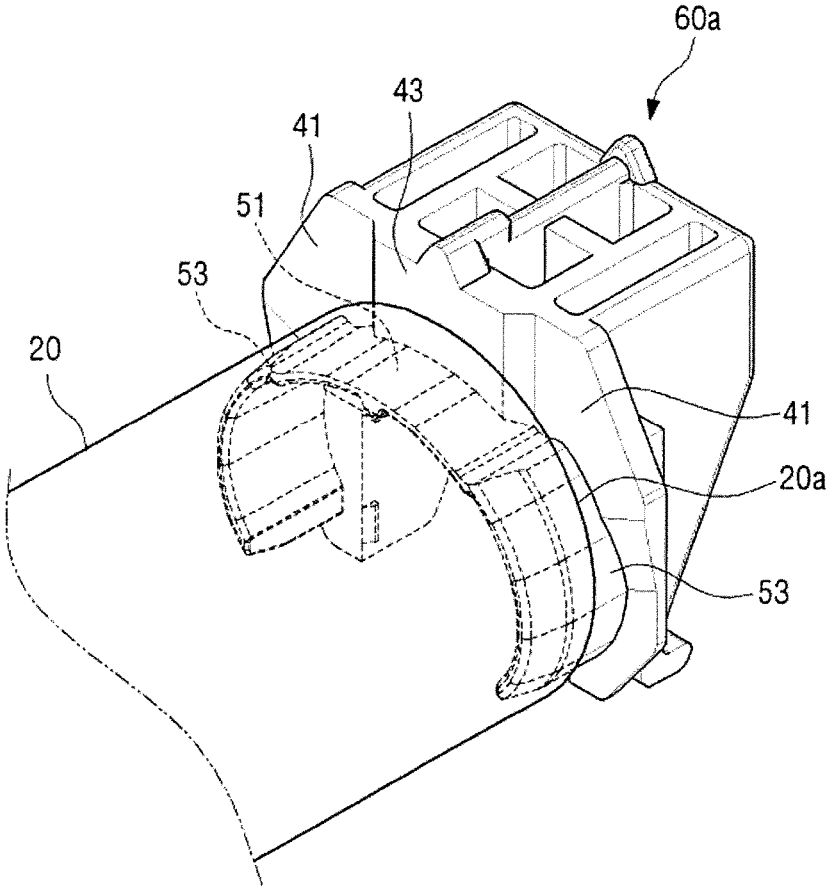
FIG. 11 is a partial perspective view illustrating a state in which the guide bush of FIG. 10 guides the fixing belt.
Figure 12:
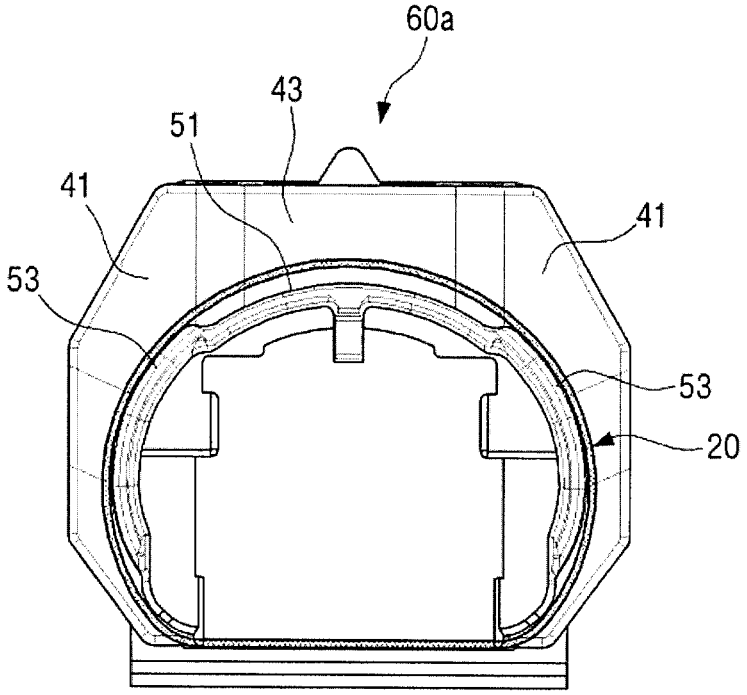
FIG. 12 is a view illustrating a state in which the guide bush of FIG. 10 guides the fixing belt.

In detail, as illustrated in FIGS. 11 and 12, when the fixing belt 20 rotates, the inner surface adjacent to the one end 20*a* of the fixing belt 20 is supported by the two sub-guide surfaces 53, and the one end 20*a* of the fixing belt 20 is restricted by the one sub-regulating surface 43. At this time, since the sub-regulating surface 43 protrudes toward the guide surface 50 more than the connecting portion between the sub-guide surface 53 and the regulating step portion 41, the one end 20*a* of the fixing belt 20 is not in contact with the connecting portion. Accordingly, the one end 20*a* of the fixing belt 20 does not receive the force acting from the inside to the outside by the round shape of the connecting portion, so that cracking of the one end 20*a* of the fixing belt 20 may be prevented.

Figure 13:
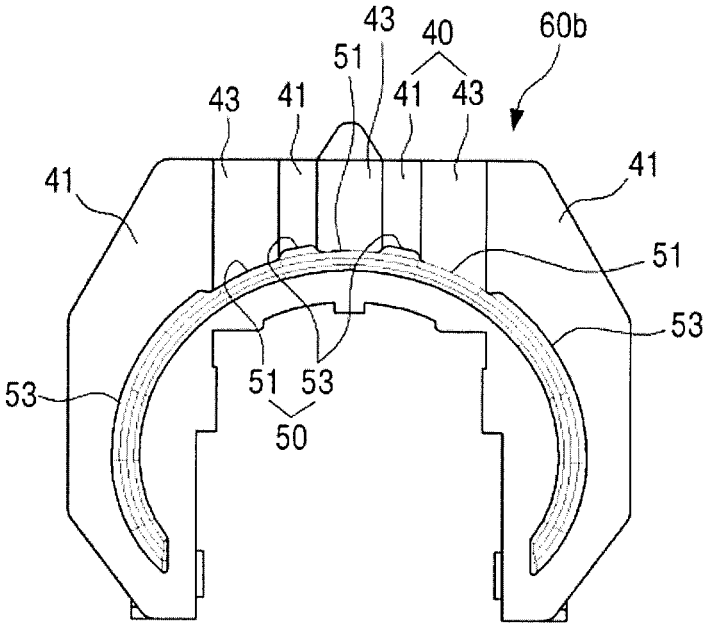
FIG. 13 is a view illustrating another example of a guide bush used in a belt type fixing apparatus according to an embodiment of the disclosure.

FIG. 13 is a front view illustrating another example of a guide bush used in a belt type fixing apparatus according to an embodiment of the disclosure.

Referring to FIG. 13, a guide bush 60*b* may include a guide surface 50 provided with four sub-guide surfaces 53 and three guide step portions 51, and a regulating surface 40 provided with three sub-regulating surfaces 43 and four regulating step portions 41. At this time, since connecting portions between the four sub-guide surfaces 53 and the four regulating step portions 41 are positioned behind the three sub-regulating surfaces 43, when the fixing belt 20 rotates along the guide surface 50 of the guide bush 60*b*, one end of the fixing belt 20 is not in contact with the connecting portions between the sub-guide surfaces 53 and the regulating step portions 41.

The above-described guide bush 60 may be formed of a material having high heat resistance. For example, the guide bush 60 may be formed of poly phenylene sulfide (PPS) or the like.

The heat source 70 is provided inside the fixing belt 20, and generates heat to heat the fixing belt 20 to the fixing temperature. As illustrated in FIG. 6, the heat source 70 is disposed on the bottom surface of the nip forming member 30 to directly heat the fixing belt 20. As the heat source 70, a ceramic heater or the like may be used. An electric wire for supplying electricity is connected to the heat source 70. However, the electric wire connected to the heat source 70 is omitted for the convenience of illustration. The heat source 70 may use a heat source used in a conventional fixing apparatus; therefore, a detailed description thereof is omitted.

In the above description, the heat source 70 is provided on the bottom surface of the nip forming member 30 to directly heat the fixing belt 20. However, the heat source 70 may be disposed above the nip forming member 30 to heat the fixing belt 20 by radiation. For example, a halogen lamp may be provided as the heat source 70 above the nip forming member 30 so that the halogen lamp radiates heat onto the inner surface of the fixing belt 20.

In the above description, the guide surface 50 and the regulating surface 40 for guiding the rotation of the fixing belt 20 are integrally formed on the guide bush 60, but the guide surface 50 and the regulating surface 40 may be formed as separate parts.

Hereinafter, a case where the guide surface and the regulating surface are formed as separate parts will be described with reference to FIGS. 14 to 17.

Figure 14:
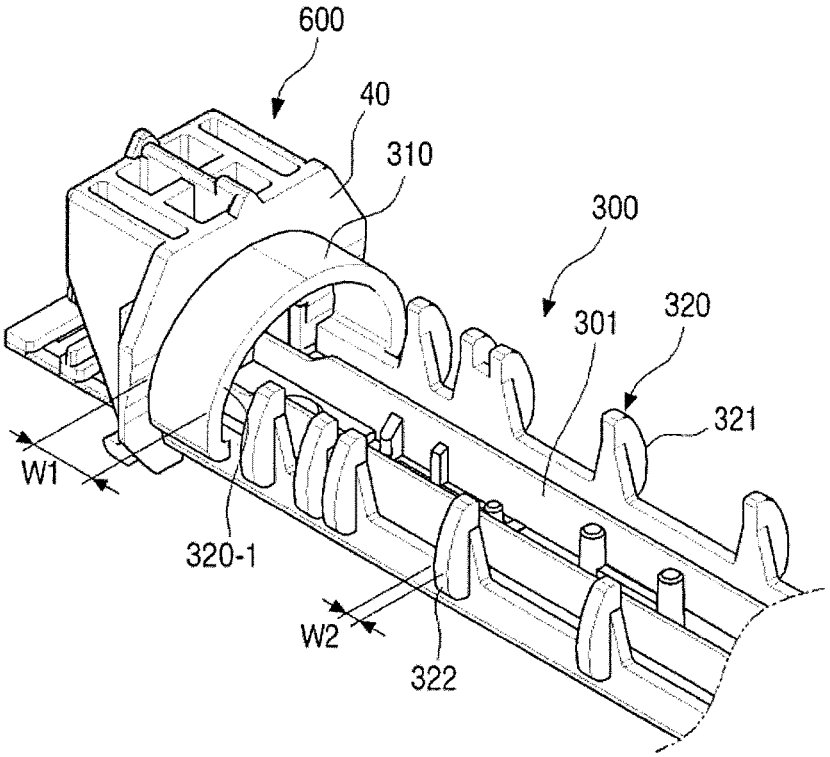
FIG. 14 is a perspective view illustrating a state in which a nip forming member and a guide bush of a belt type fixing apparatus according to an embodiment of the disclosure are assembled.
Figure 15:
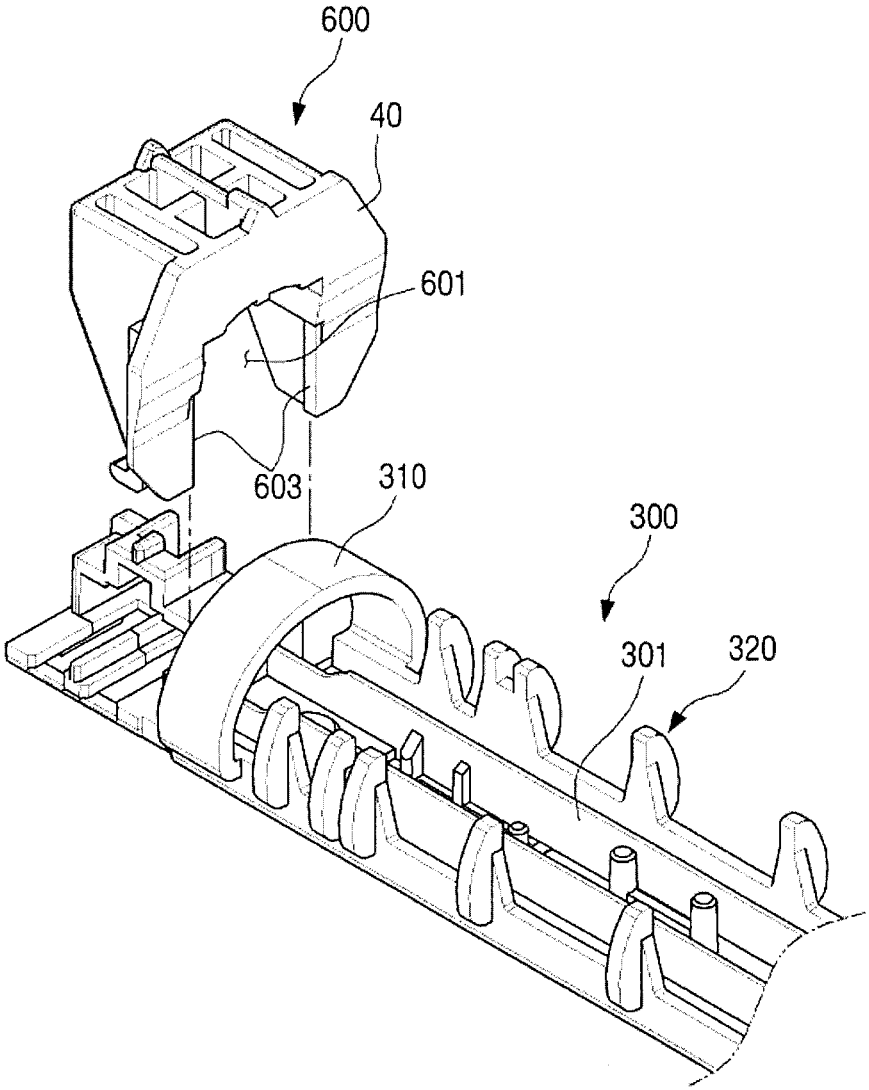
FIG. 15 is a perspective view illustrating a state in which a nip forming member and a guide bush of a belt type fixing apparatus according to an embodiment of the disclosure are separated from each other.
Figure 16:
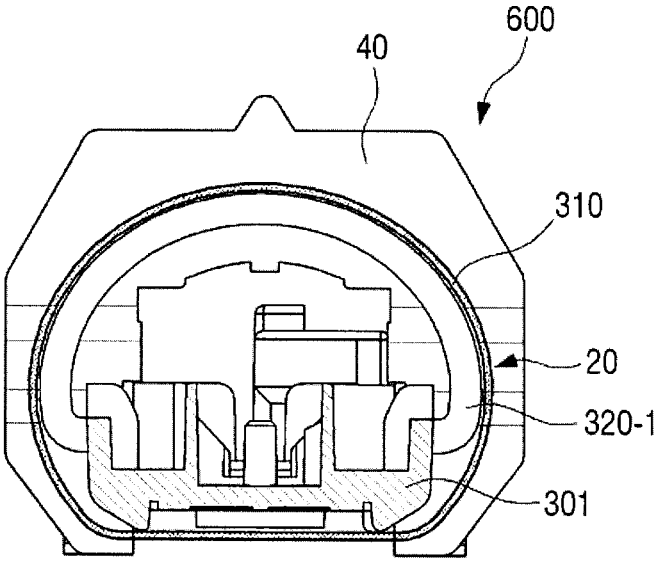
FIG. 16 is a cross-sectional view illustrating a state in which the guide bush and the nip forming apparatus of FIG. 14 guide the fixing belt.

FIG. 14 is a perspective view illustrating a state in which a nip forming member and a guide bush of a belt type fixing apparatus according to an embodiment of the disclosure are assembled. FIG. 15 is a perspective view illustrating a state in which a nip forming member and a guide bush of a belt type fixing apparatus according to an embodiment of the disclosure are separated from each other. FIG. 16 is a cross-sectional view illustrating a state in which the guide bush and the nip forming apparatus of FIG. 14 guide the fixing belt.

Referring to FIGS. 14 to 16, a front surface of each of a pair of guide bushes 600 provided at opposite ends of a nip forming member 300 forms a regulating surface 40 for restricting axial movement of the fixing belt 20, and a pair of guide surfaces 310 for guiding rotation of the fixing belt 20 are provided at portions of the nip forming member 300 adjacent to the front surfaces of the pair of guide bushes 600.

In detail, a first regulating surface 40 is provided in a first guide bush 600 disposed at one end of the fixing belt 20 to restrict the axial movement of the fixing belt 20, and a second regulating surface (not illustrated) is provided in a second guide bush (not illustrated) disposed at the other end of the fixing belt 20 to restrict the axial movement of the fixing belt 20. In other words, the front surface of the first guide bush 600 provided in the vicinity of one end of the nip forming member 300 that is disposed inside the fixing belt 20 forms the first regulating surface 40, and the front surface of the second guide bush (not illustrated) provided in the vicinity of the other end of the nip forming member 300 forms the second regulating surface.

The pair of guide surfaces 310 for supporting the inner surfaces of the opposite ends of the fixing belt 20, that is, a first guide surface 310 and a second guide surface are provided in the nip forming member 300. In detail, the first guide surface 310 is provided adjacent to the first guide bush 600 disposed at one side of the nip forming member 300, and the second guide surface is provided adjacent to the second guide bush disposed at the other side of the nip forming member 300. The first and second guide surfaces 310 may be formed by two guide ribs 320-1 which are provided near the opposite ends of the nip forming member 300 among a plurality of guide ribs 320 provided in the nip forming member 300.

For example, referring to FIG. 14, a guiding member 301 of the nip forming member 300 may include the plurality of guide ribs 320 formed in the longitudinal direction. The plurality of guide ribs 320 support the inner surface of the fixing belt 20 so that the fixing belt 20 can smoothly rotate. The guide surface 310 may be formed on each of the two guide ribs 320-1 that are provided at both ends of the plurality of guide ribs 320 and support the inner surfaces of the opposite ends of the fixing belt 20. In other words, a first guide surface 310 may be formed on the first guide rib 320-1 for supporting the inner surface adjacent to the first guide bush 600, and a second guide surface may be formed on the second guide rib (not illustrated) adjacent to the second guide bush (not illustrated). The first guide surface 310 may be formed by the top surface of the first guide rib 320-1 in contact with the inner surface of the one end of the fixing belt 20, and the second guide surface may be formed by the top surface of the second guide rib in contact with the inner surface of the other end of the fixing belt 20. Accordingly, the first guide surface 310 may support the inner surface of the fixing belt 20 in contact with the one end of the fixing belt 20, and the second guide surface may support the inner surface of the fixing belt 20 in contact with the other end of the fixing belt 20.

The first guide bush 600 is provided in the guide member 301 so that the front surface of the first guide bush 600 is in contact with or adjacent to the side surface of the first guide rib 320-1 and is perpendicular to the top surface of the first guide rib 320-1, that is, the first guide surface 310. Further, the second guide surface is provided in the guide member 301 so that the front surface of the second guide bush is in contact with or adjacent to the side surface of the second guide rib and is perpendicular to the top surface of the second guide rib, that is, the second guide surface.

Referring to FIG. 14, each of the plurality of guide ribs 320 provided in the guide member 301 may include two sub-guide ribs 321 and 322 facing each other in the width direction of the guide member 301. In detail, the guide rib 320 may include an entry side sub guide rib 321 extending from an entry end of the guide member 301 into which the fixing belt 20 enters the fixing nip N and an exit side sub guide rib 322 extending from an exit end of the guide member 301 through which the fixing belt 20 exits the fixing nip N, the above-described first guide rib 320-1 may be formed by connecting the two sub-guide ribs 321 and 322 provided at the one end of the guide member 301. Also, the second guide rib may be formed by connecting two sub-guide ribs provided at the other end of the guide member 301. At this time, the first guide surface 310 of the first guide rib 320-1 and the second guide surface of the second guide rib may be formed in an arch shape corresponding to the shape of the fixing belt 20.

Further, the width W1 of each of the two guide ribs 320-1 provided at both ends of the plurality of guide ribs 320 provided in the guide member 301, that is, the first guide rib 320-1 and the second guide rib may be formed wider than the width W2 of each of the remaining guide ribs 320 located between the first guide rib 320-1 and the second guide rib. When increasing the widths W1 of the first guide rib 320-1 and the second guide rib, the opposite end portions of the fixing belt 20 may be stably supported so that the opposite ends of the fixing belt 20 may be prevented from being wrinkled or damaged by external force.

On the other hand, the first guide bush 600 and the second guide bush may be detachably provided in the nip forming member 300.

Figure 17:
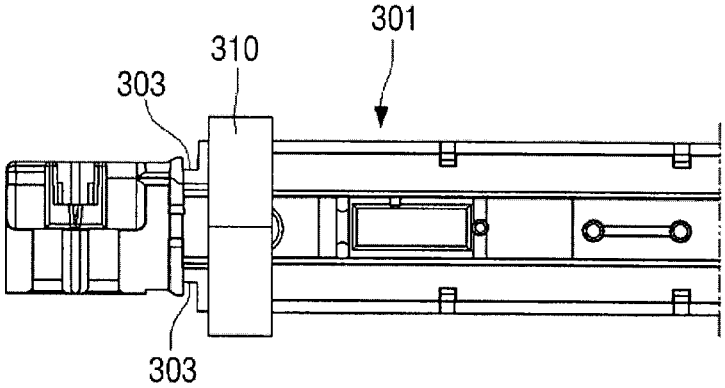
FIG. 17 is a partial plan view illustrating a nip forming member of a belt type fixing apparatus according to an embodiment of the disclosure.

FIG. 17 is a partial plan view illustrating a nip forming member of a belt type fixing apparatus according to an embodiment of the disclosure.

Referring to FIG. 15, a pair of coupling ribs 603 facing each other are formed on opposite side surfaces of an opening 601 provided in the middle of the lower portion of the first guide bush 600. Also, referring to FIG. 17, one end of the guide member 301 of the nip forming member 300 is provided with a pair of coupling slots 303 into which the pair of coupling ribs 603 of the first guide bush 600 are inserted. Accordingly, when the pair of coupling ribs 603 of the first guide bush 600 are inserted into the pair of coupling slots 303 of the guide member 301, the first guide bush 600 is firmly fixed to the guide member 301. Accordingly, movement of the first guide bush 600 for restricting the axial movement of the fixing belt 20 with respect to the guide member 301 may be minimized.

Although not illustrated, the second guide bush also has a pair of coupling ribs like the first guide bush 600, and the guide member 301 is provided with a pair of coupling slots into which the pair of coupling ribs of the second guide bush are inserted. The coupling ribs of the second guide bush and the coupling slots of the guide member 301 are the same as the coupling ribs 603 of the first guide bush 600 and the coupling slots 303 of the guide member 301 as described above; therefore, detailed descriptions thereof are omitted.

In the above description, the guide surface 310 provided in the nip forming member 300 is formed as a continuous curved surface. However, the structure of the guide surface 310 is not limited thereto. The guide surface may be formed as separate curved surfaces.

Figure 18:
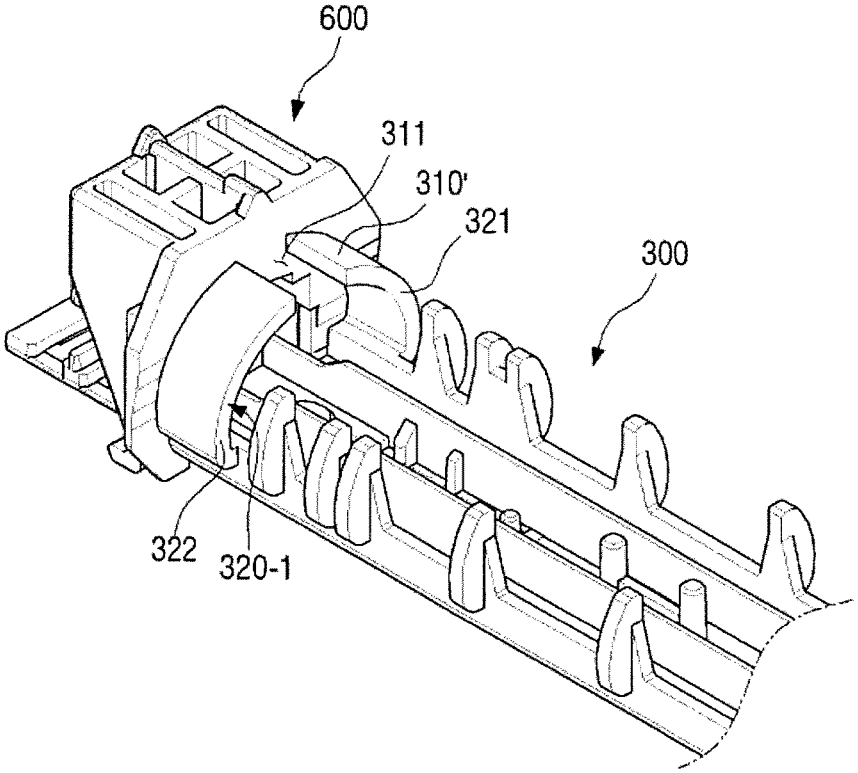
FIG. 18 is a view illustrating another example of a guide rib of a nip forming member used in a belt type fixing apparatus according to an embodiment of the disclosure.

FIG. 18 is a view illustrating another example of a guide rib of a nip forming member used in a belt type fixing apparatus according to an embodiment of the disclosure.

For example, as illustrated in FIG. 18, an opening 311 may be provided at the top of the first guide rib 320-1 adjacent to the first guide bush 600. In detail, the first guide rib 320-1 may be formed of two cut curved surfaces instead of a continuous curved surface. In other words, the entry side sub guide rib 321 and the exit side sub guide rib 322 of the guide rib 320-1 may be formed not to be connected to each other. Accordingly, the guide surface 310' may be formed as two separate curved surfaces.

On the other hand, the regulating surface 400 of the guide bush 600 for restricting the axial movement of the fixing belt 20 may be formed in a partially cut shape in order to avoid interference with the counterpart part.

Figure 19:
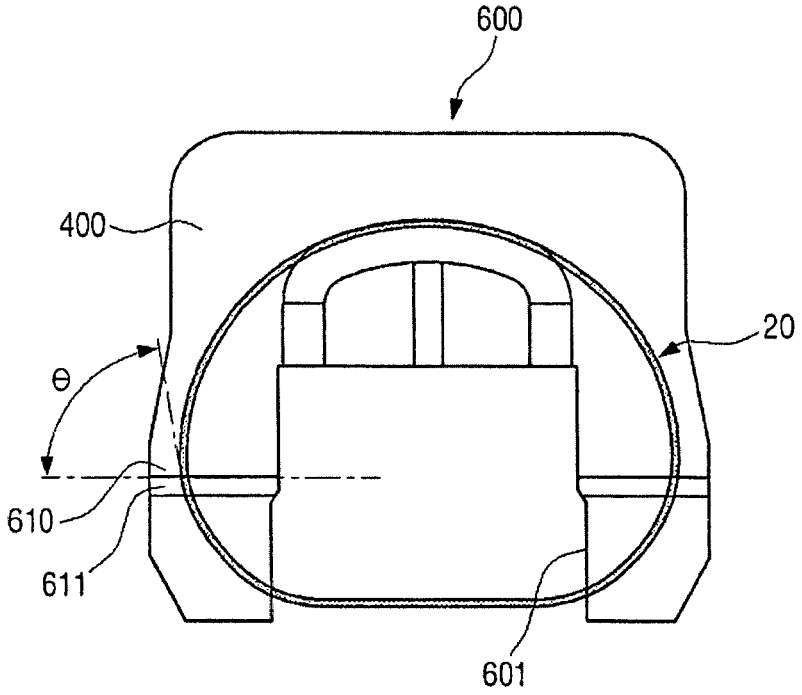
PRIOR ART FIG. 19
FIG. 19 is a view illustrating an angle between a fixing belt and an entrance end of a guide bush used in a conventional belt type fixing apparatus.

FIG. 19 is a view illustrating an angle between a fixing belt and an entrance end of a guide bush used in a conventional belt type fixing apparatus.

For example, as illustrated in FIG. 19, the guide bush 600 is provided with the opening 601 at the lower portion of the guide bush 600 to avoid interference with the guide member 301. Accordingly, when the fixing belt 20 rotates, the one end of the fixing belt 20 enters the regulating surface 400 of the guide bush 600 from the opening 601, and then comes into contact with the regulating surface 400. At this time, a portion of the guide bush 600 where contact with the fixing belt 20 starts is provided with an inclined surface 611 so that the fixing belt 20 may smoothly enter the regulating surface 400.

In FIG. 19, the fixing belt 20 rotating in the clockwise direction is brought into contact with the regulating surface 400 through the opening 601 and the inclined surface 611. In other words, the one end of the fixing belt 20 is brought into contact with the regulating surface 400 through an entrance end 610 where the inclined surface 611 and the regulating surface 400 abut. When the one end of the fixing belt 20 passes through the entrance end 610, a force F is applied to the fixing belt 20. At this time, an angle between the entrance end 610 and a tangent line of the fixing belt 20 drawn at a point where the fixing belt 20 enters the entrance end 610 is 8.

Figure 20:
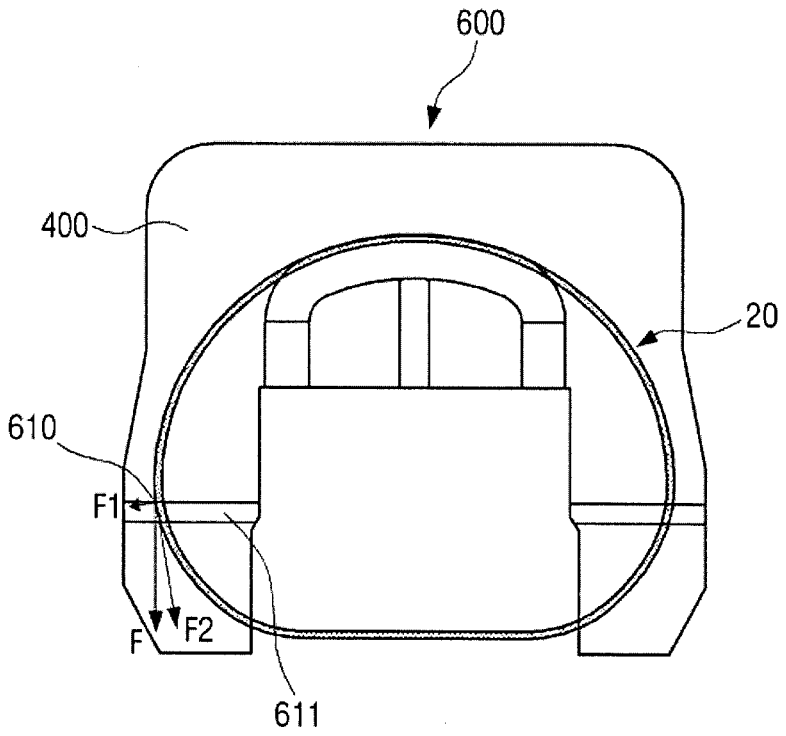
FIG. 20 is a view illustrating a force applied to a fixing belt by a guide bush used in a belt type fixing apparatus.

FIG. 20 shows the force (i.e., reaction force) applied to the fixing belt 20 at the time when the fixing belt 20 passes through the entrance end 610 of the guide bush 600. In FIG. 20, the reaction force F applied to the fixing belt 20 may be divided into a radial force component F1 and a circumferential force component F2. At this time, the larger the radial force component F1 is, the more the one end of the fixing belt 20 spread, so that the fixing belt 20 may be easily broken. Accordingly, it is desirable to minimize the radial force component F1.

When the fixing belt 20 begins to contact the regulating surface 400 at the entrance end 610 of the guide bush 600, the radial force component F1 of the force applied to the fixing belt 20 is zero when the angle θ between the entrance end 610 and the tangent line of the fixing belt 20 drawn at the entering point is 90 degrees. That is, F1=0. At this time, F2=F.

Figure 21:
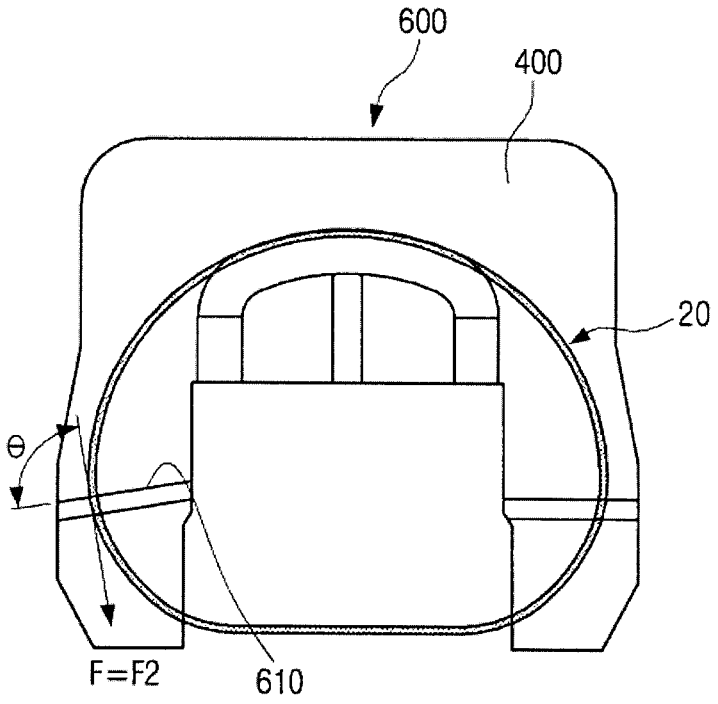
FIG. 21 is a view illustrating a force applied to a fixing belt by a guide bush used in a belt type fixing apparatus according to an embodiment of the disclosure.

Accordingly, as illustrated in FIG. 21, the entrance end 610 may be formed at an angle of 90 degrees with the tangent line of the fixing belt 20. However, the angle θ between the entrance end 610 of the guide bush 600 and the tangent line of the fixing belt 20 may be formed within a range of 90±5 degrees in consideration of the machining tolerance of the parts, the assembly deviation between the parts, and the like. Here, FIG. 21 is a view illustrating a force applied to a fixing belt by a guide bush used in a belt type fixing apparatus according to an embodiment of the disclosure.

As another embodiment, as illustrated in FIG. 7, in the case in which the regulating surface 400 may include a plurality of sub-regulating surfaces 43 and a plurality of regulating step portions 41, when the fixing belt 20 enters the sub-regulating surface 43 from the regulating step portion 41, a reaction force is applied to the fixing belt 20. Accordingly, if the angle θ between an entrance end 48 connecting the regulating step portion 41 and the sub-regulating surface 43 and the tangent line of the fixing belt 20 is caused to be 90 degrees, the radial force component of the force applied to the fixing belt 20 may be made zero.

Figure 22:
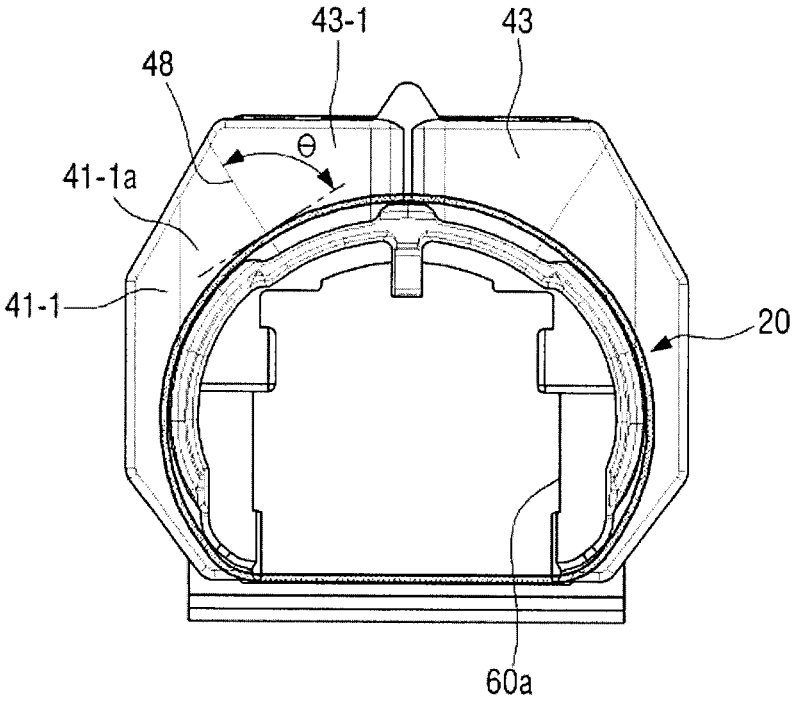
FIG. 22 is a view illustrating an angle between a fixing belt and an entrance end of a guide bush used in a belt type fixing apparatus according to an embodiment of the disclosure.

FIG. 22 is a view illustrating an angle between a fixing belt and an entrance end of a guide bush used in a belt type fixing apparatus according to an embodiment of the disclosure.

As illustrated in FIG. 22, when the fixing belt 20 rotates in the clockwise direction, the fixing belt 20 enters the first sub-regulating surface 43-1 through the inclined surface 41-1 a of the first regulating step portion 41-1 adjacent to the opening 60*a*. At this time, when the fixing belt 20 passes through the entrance end 48 where the first regulating step portion 41-1 is in contact with the first sub-regulating surface 43-1, a force is applied to the fixing belt 20, and when the angle θ between the entrance end 48 and the tangent line of the fixing belt 20 is 90 degrees, the radial force component applied to the fixing belt 20 becomes zero. In this case as well, the angle θ between the entrance end 48 and the tangent line of the fixing belt 20 may be a range of 90±5 degrees in consideration of the machining tolerance of the parts, the assembly deviation between the parts, and the like.

The inventors measured the number of printing media in which breakage occurred in the fixing belt in accordance with the change in the angle between the entrance end and the tangent line of the fixing belt.

In the case in which the angle between tangent line of the fixing belt and the entrance end was 75 degrees, the flaring of the end of the fixing belt started when approximately 90,000 sheets of the printing media were printed. However, in the case in which the angle between tangent line of the fixing belt and the entrance end was 85 degrees, the end of the fixing belt was not damaged until approximately 170,000 sheets of the printing media were printed.

The conditions of the durability test of the above-described fixing belt are as follows.

One side pressing force of the fixing apparatus; 10 Kgf

Fixing nip size; 9.5 mm

Axial diagonal force of the fixing belt (Fz); 500 gf

Inclination angle of the guide bush; 165 degrees

Reaction force applied to the fixing belt; $F=Fz\times Tan(180°-165°)=133.98$ gf When an angle between a tangent line of the fixing belt and the entrance end is 75 degrees, the radial force component of the reaction force: $F1=F\times Sin(90°-75°)=45.82$ gf When an angle between a tangent line of the fixing belt and the entrance end is 85 degrees, the radial force component of the reaction force: $F1=F\times Sin(90°-8°)=11.68$ gf As described above, when the angle between the tangent line of the fixing belt and the entrance end is set to be close to 90 degrees, the force applied to the fixing belt is reduced, so that the lifetime of the fixing belt may be prolonged.

Hereinafter, an image forming apparatus 100 provided with a belt type fixing apparatus 1 according to an embodiment of the disclosure will be described with reference to FIG. 23.

Figure 23:
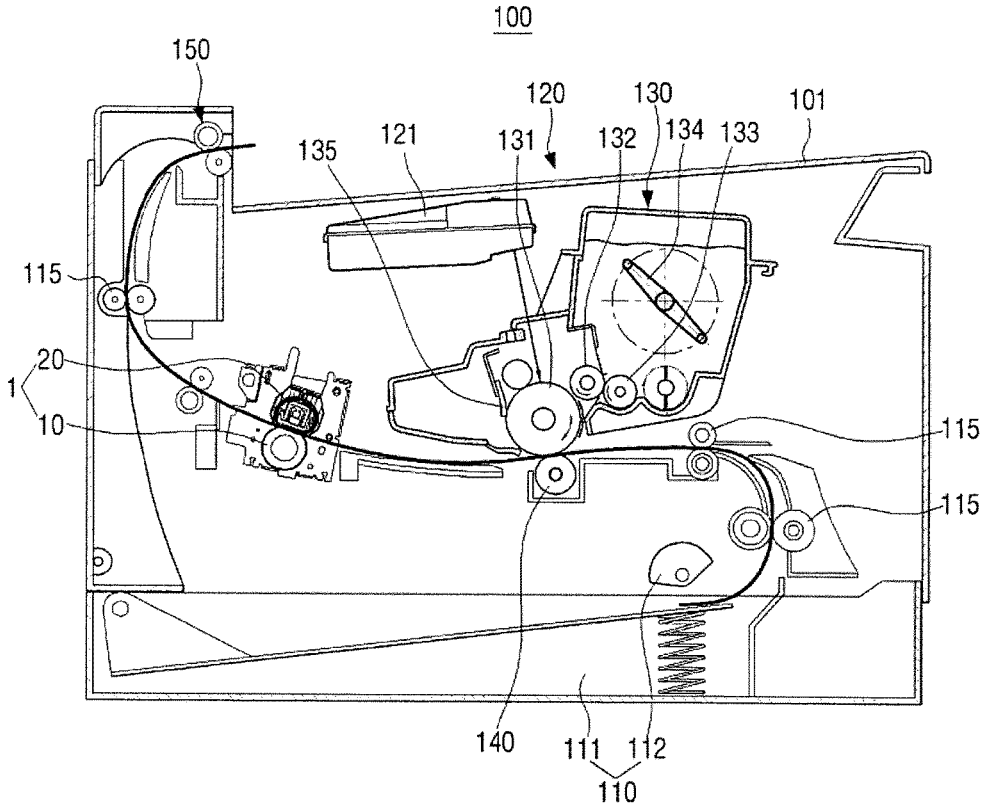
FIG. 23 is a cross-sectional view schematically illustrating an image forming apparatus including a belt type fixing apparatus according to an embodiment of the disclosure.

FIG. 23 is a cross-sectional view schematically illustrating an image forming apparatus including a belt type fixing apparatus according to an embodiment of the disclosure.

Referring to FIG. 23, the image forming apparatus 100 may include a main body 101, a printing medium feeding unit 110, an image forming unit 120, a belt type fixing apparatus 1, and a printing medium discharging unit 150.

The main body 101 forms an appearance of the image forming apparatus 100, accommodates the printing medium feeding unit 110, the image forming unit 120, the belt type fixing apparatus 1, and the printing medium discharging unit 150 therein, and fixes and supports them.

The printing medium feeding unit 110 is disposed inside the main body 101 to supply the printing medium P to the image forming unit 120, and may include a printing medium feeding cassette 111 and a pickup roller 112. The printing medium feeding cassette 111 accommodates a predetermined number of printing media, and the pickup roller 112 picks up the printing medium P accommodated in the printing medium feeding cassette 111 one by one, and supplies the printing medium P to the image forming unit 120.

A plurality of conveying rollers 115 for conveying the printing medium P picked up by the pickup roller 112 are provided between the pickup roller 112 and the image forming unit 120.

The image forming unit 120 forms a predetermined image on the printing medium P supplied from the printing medium feeding unit 110, and may include an exposure unit 121, a developing cartridge 130, and a transfer roller 140. The exposure unit 121 emits a predetermined light corresponding to the print data depending to the printing command. The developing cartridge 130 may include an image carrier 131 on which an electrostatic latent image is formed by the light emitted from the exposure unit 121, and a developing roller 132 which is disposed at a side of the image carrier 131, and supplies developer to the image carrier 120, thereby developing the electrostatic latent image formed on the image carrier 131 into a developer image. In addition, the developing cartridge 130 stores a predetermined amount of developer, and may include a developer supply roller 133 for supplying the developer to the developing roller 132, an agitator 134 for agitating the developer, a cleaning blade 135 for cleaning the surface of the image carrier 131, and the like. The transfer roller 140 is rotatably disposed to face the image carrier 131 of the developing cartridge 130, and transfers the developer image formed on the image carrier 120 onto the printing medium P.

The belt type fixing apparatus 1 fixes the developer image onto the printing medium P by applying heat and pressure while the printing medium P on which the developer image is transferred in the image forming unit 120 passes through the belt type fixing apparatus 1, and may include a fixing roller 10 and a fixing belt 20. The structure and operation of the belt type fixing apparatus 1 are described above; therefore, a detailed description thereof will not be repeated for the sake of brevity.

The printing medium discharging unit 150 discharges the printing medium P on which the image is fixed while passing through the belt type fixing apparatus 1, to the outside of the image forming apparatus 100. The printing medium discharging unit 150 may include a pair of discharging rollers that face each other and rotate.

As described above, the belt type fixing apparatus 1 according to one or more embodiments of the disclosure may fix the developer image transferred to the printing medium P onto the printing medium P.

Also, the belt type fixing apparatus according to one or more embodiments of the disclosure does not have a round shape that connects the guide surface and the regulating surface of the guide bush in the regions through which the opposite ends of the fixing belt pass. Therefore, the fatigue cracks at the opposite ends of the fixing belt, which are generated when the fixing belt climbs up the round shape, may be minimized.

While various embodiments of the disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

Although example embodiments have been shown and described, it would be appreciated by those skilled in the art that changes may be made to these embodiments without departing from the principles and spirit of the disclosure, the scope of which is defined in the claims and their equivalents.

What is claimed is:

1. A belt type fixing apparatus, comprising:

a fixing belt;

a fixing roller disposed to face the fixing belt;

a nip forming member disposed inside the fixing belt and to press the fixing belt to the fixing roller to form a fixing nip;

first and second regulating surfaces, facing toward one another in an axial direction of the fixing belt and disposed at opposite ends of the nip forming member, to restrict an axial movement of the fixing belt; and first and second guide surfaces, disposed inside the fixing belt and facing in an outward radial direction of the fixing belt toward an inner surface of the fixing belt, to guide rotation of the fixing belt, wherein the first regulating surface includes at least one first regulating step portion not in contact with one end of the fixing belt and the second regulating surface includes at least one second regulating step portion not in contact with another end of the fixing belt, the first guide surface includes at least one first guide step portion not in contact with the inner surface of the fixing belt and the second guide surface includes at least one second guide step portion not in contact with the inner surface of the fixing belt, and the at least one first regulating step portion and the at least one first guide step portion alternate with respect to one another in a circumferential direction of the fixing belt.

2. The belt type fixing apparatus of claim 1, wherein the first regulating surface and the first guide surface are integrally formed with a first guide bush disposed at the one end of the fixing belt, and the second regulating surface and the second guide surface are integrally formed with a second guide bush disposed at the another end of the fixing belt.

3. The belt type fixing apparatus of claim 2, wherein the first regulating surface includes an entrance end at which the fixing belt is to enter during rotation of the fixing belt, and an angle between the entrance end and a tangent line of the fixing belt at a point where the fixing belt enters the entrance end is in a range of about 85 degrees to about 95 degrees.

4. The belt type fixing apparatus of claim 3, wherein the angle between the entrance end and the tangent line of the fixing belt at the point where the fixing belt enters the entrance end is about 90 degrees.

5. The belt type fixing apparatus of claim 1, wherein an entire portion of the first guide surface is substantially perpendicular to the first regulating surface in the axial direction of the fixing belt, an entire portion of the second guide surface is substantially perpendicular to the second regulating surface in the axial direction of the fixing belt, the first guide surface is disposed to be in contact with and to support at least a portion of an edge of a bottom surface of the fixing belt also in contact with at least a portion of the first regulating surface disposed at the one end of the fixing belt, and the second guide surface is disposed to be in contact with and to support at least a portion of another edge of the bottom surface of the fixing belt also in contact with at least a portion of the second regulating surface disposed at the another end of the fixing belt.

6. The belt type fixing apparatus of claim 1, wherein the number of the at least one first regulating step portion is larger than the number of the at least one first guide step portion.

7. The belt type fixing apparatus of claim 6, wherein the first guide surface includes two first guide step portions, and the second guide surface includes two second guide step portions and the first regulating surface includes three first regulating step portions and the second regulating surface includes three second regulating step portions.

8. The belt type fixing apparatus of claim 1, wherein the at least one first regulating step portion intersects with another surface of the first guide surface other than the at least one first guide step portion, and the at least one first guide step portion intersects with another surface of the first regulating surface other than the first guide surface.

9. The belt type fixing apparatus of claim 1, wherein the at least one first regulating step portion is recessed in the axial direction relative to adjacent surfaces of the first regulating surface, and the at least one first guide step portion is recessed in the radial direction relative to adjacent surfaces of the first guide surface.

10. A belt type fixing apparatus, comprising:

a fixing belt;

a fixing roller disposed to face the fixing belt;

a nip forming member disposed inside the fixing belt and to press the fixing belt to the fixing roller to form a fixing nip;

first and second regulating surfaces disposed at opposite ends of the nip forming member to restrict an axial movement of the fixing belt; and first and second guide surfaces disposed inside the fixing belt to guide rotation of the fixing belt, wherein the first regulating surface includes at least one first regulating step portion not in contact with one end of the fixing belt and at least one first sub-regulating surface in contact with the one end of the fixing belt, the second regulating surface includes at least one second regulating step portion not in contact with another end of the fixing belt and at least one second sub-regulating surface in contact with the another end of the fixing belt, the first guide surface includes at least one first guide step portion not in contact with an inner surface of the fixing belt and at least one first sub-guide surface in contact with the inner surface of the fixing belt, the second guide surface includes at least one second guide step portion not in contact with the inner surface of the fixing belt and at least one second sub-guide surface in contact with the inner surface of the fixing belt, the at least one first regulating step portion and the at least one first guide step portion alternate with respect to one another in a circumferential direction of the fixing belt, and the at least one first sub-regulating surface and the at least one first sub-guide surface alternate with respect to one another in the circumferential direction of the fixing belt.

11. The belt type fixing apparatus of claim 10, wherein the number of the at least one first sub-guide surface is larger than the number of the at least one first sub-regulating surface.

12. A belt type fixing apparatus, comprising:

a fixing belt;

a fixing roller disposed to face the fixing belt;

a nip forming member disposed inside the fixing belt to press the fixing belt to the fixing roller to form a fixing nip;

first and second regulating surfaces disposed at opposite ends of the nip forming member to restrict an axial movement of the fixing belt, the first regulating surface being disposed on a first guide bush disposed at one end of the fixing belt and the second regulating surface being disposed on a second guide bush disposed at another end of the fixing belt; and first and second guide surfaces disposed inside the fixing belt to guide rotation of the fixing belt, the first guide surface being disposed adjacent to the first guide bush at one end of the nip forming member and the second guide surface being disposed adjacent to the second guide bush at another end of the nip forming member, wherein the first guide bush and the second guide bush each include a pair of coupling ribs, and the nip forming member includes a pair of coupling slots at the one end of the nip forming member into which the pair of coupling ribs of the first guide bush are inserted and another pair of coupling slots at the another end of the nip forming member into which the pair of coupling ribs of the second guide bush are inserted.

13. The belt type fixing apparatus of claim 12, wherein the nip forming member includes a plurality of guide ribs disposed in a longitudinal direction, and the first guide surface includes at least one first guide rib among the plurality of guide ribs, the at least one first guide rib being disposed at one end of the plurality of guide ribs, and the second guide surface includes at least one second guide rib among the plurality of guide ribs, the at least one second guide rib being disposed at another end of the plurality of guide ribs.

14. The belt type fixing apparatus of claim 13, wherein the plurality of guide ribs of the nip forming member include a first sub-guide rib extended from a first side of the nip forming member at which the fixing belt enters the fixing nip and a second sub-guide rib extended from a second side of the forming member opposite of the first side, and the at least one first guide rib includes a third sub-guide rib extended from the first side and a fourth sub-guide rib extended from the second side, the third and fourth sub-guide ribs being connected to each other.

15. The belt type fixing apparatus of claim 14, wherein the first guide surface and the second guide surface each have an arch shape.

16. The belt type fixing apparatus of claim 12, wherein the first guide bush and the second guide bush are detachably disposed in the nip forming member.

17. The belt type fixing apparatus of claim 12, wherein the first guide bush includes an entrance end to guide the fixing belt to the first regulating surface during rotation of the fixing belt, and an angle between the entrance end and a tangent line of the fixing belt at a point where the fixing belt enters the entrance end is in a range of about 85 degrees to about 95 degrees.

18. The belt type fixing apparatus of claim 17, wherein the angle between the entrance end and the tangent line of the fixing belt at the point where the fixing belt enters the entrance end is about 90 degrees.

19. A belt type fixing apparatus, comprising:

a fixing belt;

a fixing roller disposed to face the fixing belt;

a nip forming member disposed inside the fixing belt to press the fixing belt to the fixing roller to form a fixing nip, the nip forming member including a plurality of guide ribs disposed along a longitudinal direction;

first and second regulating surfaces disposed at opposite ends of the nip forming member to restrict an axial movement of the fixing belt, the first regulating surface being disposed on a first guide bush disposed at one end of the fixing belt and the second regulating surface being disposed on a second guide bush disposed at another end of the fixing belt; and first and second guide surfaces provided in the nip forming member inside the fixing belt to guide rotation of the fixing belt, the first guide surface being disposed adjacent to the first guide bush at one end of the nip forming member and the second guide surface being disposed adjacent to the second guide bush at another end of the nip forming member, wherein the first guide surface includes at least one first guide rib among the plurality of guide ribs, the at least one first guide rib being disposed at one end of the plurality of guide ribs, and the second guide surface includes at least one second guide rib among the plurality of guide ribs, the at least one second guide rib being disposed at another end of the plurality of guide ribs, and a width of the at least one first guide rib and the at least one second guide rib is wider than widths of remaining guide ribs among the plurality of guide ribs.

20. An image forming apparatus, comprising:

an image forming unit to form an image on a recording medium; and a belt type fixing apparatus to fix the image onto the recording medium, the belt type fixing apparatus including:

a fixing belt;

a fixing roller disposed to face the fixing belt;

a nip forming member disposed inside the fixing belt and to press the fixing belt to the fixing roller to form a fixing nip;

first and second regulating surfaces, facing toward one another in an axial direction of the fixing belt and disposed at opposite ends of the nip forming member, to restrict an axial movement of the fixing belt; and first and second guide surfaces, disposed inside the fixing belt and facing in an outward radial direction of the fixing belt toward an inner surface of the fixing belt, to guide rotation of the fixing belt, wherein the first regulating surface includes at least one first regulating step portion not in contact with one end of the fixing belt and the second regulating surface includes at least one second regulating step portion not in contact with another end of the fixing belt, the first guide surface includes at least one first guide step portion not in contact with the inner surface of the fixing belt and the second guide surface includes at least one second guide step portion not in contact with the inner surface of the fixing belt, and the at least one first regulating step portion and the at least one first guide step portion alternate with respect to one another in a circumferential direction of the fixing belt.

* * * * *